United States Patent [19]

Harbeke

[11] Patent Number: 4,642,956

[45] Date of Patent: Feb. 17, 1987

[54] FIRE-RETARDANT FLUID COUPLING ASSEMBLY AND METHOD

[76] Inventor: Gerold Harbeke, 2807 S. Military Trail, West Palm Beach, Fla. 33415

[21] Appl. No.: 813,450

[22] Filed: Dec. 26, 1985

Related U.S. Application Data

[63] Continuation-in-part of Ser. No. 729,495, May 1, 1985.

[51] Int. Cl.[4] ..... E04C 2/00

[52] U.S. Cl. ..... 52/232; 52/221; 264/35

[58] Field of Search ..... 52/232, 1, 221; 285/64, 285/192, 158; 264/35

[56] References Cited

U.S. PATENT DOCUMENTS

| | | | |
|---|---|---|---|
| 1,391,988 | 9/1921 | Zents . | |
| 1,746,696 | 2/1930 | Dows . | |
| 1,908,796 | 5/1933 | Suchan . | |
| 2,234,784 | 3/1941 | Stolz | 25/128 |
| 2,968,855 | 1/1961 | Stolz | 25/128 |
| 3,294,358 | 12/1966 | Hagedorn | 249/175 |
| 3,346,230 | 10/1967 | Tolf, Jr. | 249/177 |
| 3,821,338 | 6/1974 | Faust | 264/35 |
| 4,136,707 | 1/1979 | Gaillot et al. | 52/232 X |
| 4,221,092 | 9/1980 | Johnson | 52/232 |
| 4,261,598 | 4/1981 | Cornwall | 285/56 |
| 4,272,643 | 6/1981 | Carroll et al. | 52/232 X |
| 4,313,286 | 2/1982 | Harbeke | 52/220 |
| 4,427,173 | 1/1984 | MacKay | 249/39 |
| 4,453,354 | 6/1984 | Harbeke | 52/220 |

OTHER PUBLICATIONS

Brochure—Coastal Construction Products, Inc., 660 N. W. 85th Street, Miami, FL 33150, #80-6101-6005-5, pp. 1-6.

*Primary Examiner*—Carl D. Friedman

*Attorney, Agent, or Firm*—Griffin, Branigan & Butler

[57] ABSTRACT

A fire-retardant fluid-coupling assembly includes a female-female, fluid-conveying pipe-coupling joint (24) without a flange thereon, a particular mounting system (22) for mounting the fluid-conveying pipe-coupling joint to the bottom wall (26) of a concrete form and an intumescent material wrap (25) wrapped about the fluid-conveying pipe-coupling joint at the form-wall-mounting end thereof. In a method of constructing a fire-retardant fluid-coupling with the assembly, the pipe-coupling joint (24) is mounted by the mounting system (22) to a bottom wall (26) of a concrete form with the intumescent material wrapped about the joint immediately adjacent the form wall and in contact therewith. Concrete (30) is then poured and allowed to harden. Once the form has been removed, the intumescent material is exposed to atmosphere at the bottom of a concrete floor constructed by the form so that a fire in the story below immediately heats the wrap of intumescent material, causing it to expand and close off the fluid-conveying pipe-coupling.

7 Claims, 3 Drawing Figures

FIRE-RETARDANT FLUID COUPLING ASSEMBLY AND METHOD

BACKGROUND OF THE INVENTION

This application is a continuation-in-part application of U.S. patent application No. 06/729,495 filed May 1, 1985.

This invention relates generally to the art of pipe networks for buildings and especially to apparatus and systems for making pipe networks more fire-retardant.

Until recently, pipe networks were normally extended through floors of buildings by forming holes in the floors—e.g. by using void-forming devices during the "pouring" of the floors, by knocking out holes, by boring such holes after the floors had been formed, etc.—and thereafter extending pipes through these holes. Normally the holes were made to be bigger than the pipes to ensure that one could easily extend the pipes through the holes. Thereafter, it was necessary for workmen to fill the spaces between the pipes and the holes with cement or some other substance in order meet fire codes which generally do not allow holes in floors.

Within the last few years, there have been a number of patents issued, such as Harbeke (U.S. Pat. No. 4,453,354) and Cornwall (U.S. Pat. No. 4,261,598) disclosing the concept of cementing pipe-coupling joints into floors when the floors are poured and thereafter, mating external pipes to female opposite ends of the embedded coupling joints. Such a practice is normally carried out with plastic pipe, however, it could also be carried out with pipes made of other materials.

A major fire problem which still exists for pipe-coupling joints which are embedded in floors is that when there is a fire the fire will melt the external plastic pipes and then will pass up through the pipe-coupling joints to the next floor. In other words, the pipe coupling joints themselves serve as ventilation holes for fires. It is an object of this invention to provide an assembly and structure for extending a pipe network through a building floor using embedded pipe coupling joints without allowing the pipe joints themselves to become fire ventilation holes.

It is a further object of this invention to provide a method and assembly for embedding a pipe-coupling joint in a concrete floor in such a manner that in the event of fire the coupling jcint is closed off to the flow of air, heat and fire through the coupling joint.

It is a further object of this invention to provide a fire-retardant fluid-coupling which acts quickly enough to prevent a fire from spreading to the next higher story through a bore of the fluid coupling.

SUMMARY

According to principles of this invention, a fire-retardant fluid-coupling is constructed by wrapping an intumescent material about an end of a female/female pipe coupling joint which does not have a flange and then using a particular mounting system for mounting this fluid-conveying pipe-coupling joint on the bottom wall of a floor form with the intumescent material being adjacent to the form wall. The particular mounting system comprises a compression column engaging the form wall and a disc attached to the outer end of the compression column engaging the outer end of the fluid-conveying pipe-coupling joint. The pipe-coupling, joint with the wrap of intumescent material, is thusly encased in the concrete floor with the end of the wrap of intumescent material being exposed at the bottom side of the concrete floor. In case of fire in the story below the concrete floor, the intumscent material expands against the concrete floor to close off the lower end of the fluid-conveying pipe-coupling joint.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

In the prior art, two types of fluid-conveying pipe-coupling joints 10 and 12 (FIG. 1) have flanges 14 and 16 thereon which are nailed to a wooden concrete form wall 18. Concrete 20 is then poured to embed the coupling joints 10 and 12 in the concrete 20. A difficulty with these prior-art coupling joints is that it is difficult to use them with metallic forms and these systems require the stocking of various size coupling joints for various depth pours.

Figure 2:
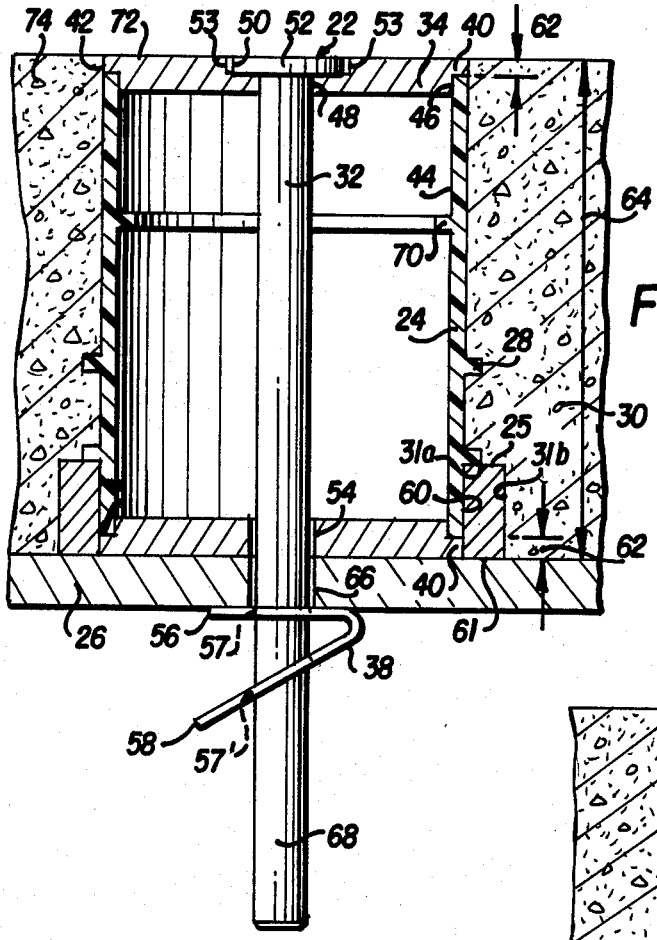
FIG. 2 is a side, partially sectional, view of a fluid-coupling assembly of this invention depicting the method of its use with a floor form.

With reference to FIG. 2, a fire-retardant fluid-coupling assembly includes a pipe-coupling joint support apparatus 22, a female/female pipe coupling joint 24 which is rigidly compress-supported to a steel form 26 by the joint support apparatus, and an intumescent material wrap 25. The pipe coupling 24 has annular anchors 28 extending about the outer surface thereof to prevent longitudinal movement within concrete 30 once it has cured.

The support apparatus 22 comprises an elongated compression column 32, an outer double diameter disc 34, an inner double diameter disc 36, and a fastening member 38. The outer disc 34 has an upper flange 40 with a circular outer perimeter 42 which has a diameter which is larger than the diameter of an internal bore 44 of the pipe-coupling joint 24. A circular plug portion 46 of the outer diameter disc 34 has a diameter which is the same, or slightly smaller than the diameter of the internal bore 44 of the pipe-coupling joint 24 so that it can be snuggly inserted into the outer end thereof as is shown in FIG. 2 to provide a rigidity between these two members. There is a counter-sunk hole 48 passing through the center of the outer double diameter disc 34 whose counter-sunk notch at 50 receives a head 52 of the elongated compression column 32 so that the head does not extend beyond the outer surface of the outer disc 34. The head 52 is welded to the disc 34 at 53 to provide rigidity between the compression column 32 and the outer disc 34.

The inner double diameter disc 36 has a structure which is exactly the same as the structure of the outer double diameter disc 34 with the exception that a hole 54 passing through the center thereof does not need to be counter-sunk as is the hole 48, although it could be in order to provide interchangeability of parts. Further, the compression column 32 is not welded or otherwise attached to the inner disc 36.

In the depicted embodiment, the elongated compression column 32 is an aluminum cylindrical shaft whose head 52 is integral therewith. The shaft is at least 10 inches long and is preferably around 12 inches long. The inner and outer discs 34 and 36 are also formed of aluminum.

The fastening member 38 depicted in FIG. 2 is merely a spring clip having two hingedly attached members 56 and 58, each respectively having a hole 57 and 57' therein through which the elongated cylindrical shaft 32 extends and each being biased hingedly away from the other so that the fastening member 38 binds itself on the elongated compression column 32. In this respect, the fastening member 38 can be loosened from the elongated compression column 32 by simply pressing the members 56 and 58 together. The fastening member 38 can then be slid along the column and it can be again clamped in any position along the column by simply allowing the members 56 and 58 to be biased away from one another. In one embodiment the fastening member is attachable to the compression column at all locations between its lowermost tip to a point $4\frac{1}{4}$ inches from the top of its head 52. This is to allow the use of the support apparatus with a form of $\frac{1}{4}$ inch steel for pours ranging from 4 inches on up, however, in the preferred embodiment the range of fastening need extend only to about 5 inches from the top of the head 52 since most forms are thicker than $\frac{1}{2}$ inch.

The torroidal wrap 25 of an intumescent material is placed about the form-wall mounting end portion 60 of the tubularly-shaped wall of the fluid-conveying pipe-coupling joint 24. As can be seen in FIG. 2, this toroidal wrap 25 of intumescent material is immediately adjacent to the bottom form wall 26 and is therefore in position to have its outer and upper surfaces covered with concrete along with the pipe-coupling joint 24, but its lower and inner surfaces will remain substantially free of concrete. In the preferred embodiment, the intumescent fireproofing toroidal wrap 25 is fire barrier strip/-wrap FS-195 manufactured by 3M of St. Paul, Minn., however, it could also be caulk #CP-25 or putty 303, both of which are also manufactured by 3M. Its thickness and height is designed to expand such that it closes off the internal bore 44 of the pipe-coupling joint 24 when its temperature is raised.

In operation of the fire-retardant fluid-coupling joint assembly of FIG. 2, one who is responsible for attaching pipe coupling joints to the form wall 26 for making a pour of concrete 30 of a particular depth selects (which might include fashioning) a pipe-coupling joint 24 of a length such that when this length is added to thicknesses 62 of the flanges 40 it equals the thickness 64 of the pour 30. In this respect, the support apparatus 22 of this invention can be used with a pour of any thickness, one must simply cut off, or add to, the length of the pipe-coupling joint 24 to make the pipe coupling assembly with its end discs the same as the depth, or thickness of the pour. Thereafter, one must bore one hole 66 in the form wall 26 at the position at which he intends to mount the pipe coupling 24. The plug portions 46 of the outer and inner double diameter discs 34 and 36 are inserted into opposite ends of the pipe-coupling joint 24 with elongated compression column 32 being placed through the hole 54 of the inner discs 36, while its head 52 is attached to the outer disc 34. The opposite end 68 of the compression column is extended through the hole 66 in the form 60 and the fastening means 38 is attached to the elongated compression column 32 at a position contacting the form 26 with the compression column end 68 being pulled away from the form 60 so as to fixedly compress the form-wall end 60 of the pipe-coupling joint 24 between the outer double diameter disc 34 and the form wall 26, with, of course, the inner disc 36 being therebetween.

Figure 1:
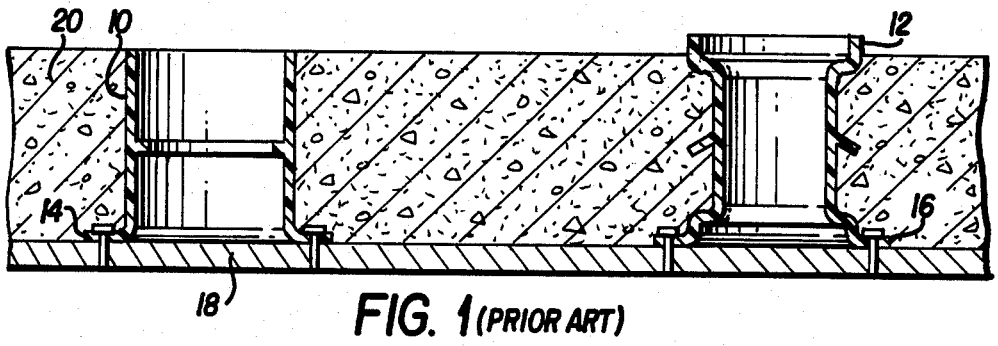
FIG. 1 (PRIOR ART)
FIG. 1 is a side sectional view of prior-art fluid-conveying, pipe-coupling joints mounted on wooden forms and embedded in a concrete floor.

As can be seen in FIG. 2, with this support apparatus 22 there is no need for the pipe-coupling joint 24 to have mounting flanges 14 or 16 shown in FIG. 1 and for this reason, the toroidal wrap 25 of intumescent material is immediately adjacent to the bottom form wall 26.

As will be appreciated, the supporting apparatus of this device only requires one hole in the form and this same hole, with the supporting apparatus can be used for supporting pipe couplings of different sizes for different pours. Since the fastening means 38 can be attached at any usable position along the elongated compression column 32, this column, along with discs 34 and 36, and the fastening means 38, can be used for many different-depth pours.

It should be noted that the upper flange 40 of the outer disc 34 and the lower flange 40' of the lower disc 36 actually create circular disc forms above and below the pipe coupling 24 which produce holes between opposite surfaces of the concrete barrier 30 and the ends of the pipe coupling 24 to allow access for pipes introduced into the coupling 24 from outside the barrier. Through these holes molded in the concrete by the outer perimeters 42 of the flanges 40 and 40' pipes (not shown in FIG. 2), are inserted into the internal bore 44 from opposite ends, each being prevented from going beyond an annular rim 70 which is integral with the pipe coupling 24 and which rises from the internal bore 44.

It should be noted that the outer surface 72, beyond the thickness 62 of the flange 40, is in the plane of the upper surface 74 of the concrete barrier 30 (floor) and that there is nothing extending upwardly from the support apparatus 22 above the barrier surface 74. This is important so that concrete machines working the upper surface of the barrier 74 are not impeded by the supporting apparatus 22.

Once the concrete 30 has cured and its surface 74 has been machined, the individual responsible for the pipes of the building removes the fastener 38 and drives the compression column 32 from its end 68 upwardly, as seen in FIG. 2 so as to drive the outer disc upwardly and out of the concrete barrier 30. If any concrete has formed over the outer disc 34 this is knocked off by the driving of the compression column 32. The inner disc 36 can be knocked out from the other side after the outer disc has been removed and after the form 26 has been removed. The inner disc 36 is generally easier to remove than the outer disc 34 because the form 26 prevents concrete from forming around it.

Once the bottom form wall 26 has been removed, a lower edge 61 of the toroidal intumescent fireproofing wrap 25 is exposed to atmosphere on the bottom side of the concrete floor 30 so that it quickly heats up in the event of a fire therebelow. This, of course, raises the temperature of the wrap 25 causing it to expand against surfaces 30*a* and 30*b* of the concrete floor 30 inwardly to thereby close off the lower mouth of the pipe coupling 24 and prevent the internal bore 44 of the pipe coupling 24 from serving as a fire and heat ventilation opening.

Figure 3:
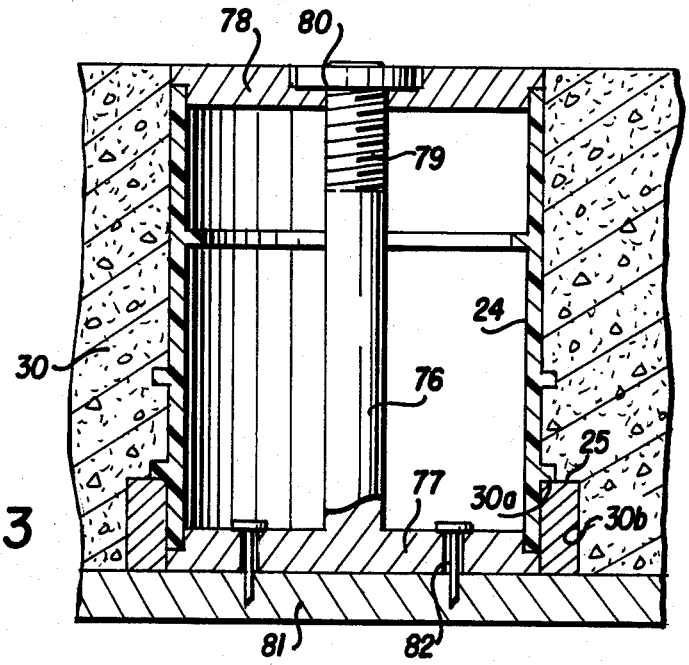
FIG. 3 is a side, partially sectional, view of a second embodiment of the fire-retardant fluid-coupling joint assembly of FIG. 2 depicting a method of its use with a floor form.

The embodiment of FIG. 3 is substantially the same as the embodiment of FIG. 2 with the exception that a compression column 76 is affixed to an inner double diameter disc 77 rather than to an outer double diameter disc 78 and it is threaded at its top end portion 79 so that a nut 80 can be screwed onto the threaded portion 79 to drive the outer double diameter disc 78 against outer ends of the pipe coupling 24. In this case, the inner double diameter disc 77 is nailed or screwed to a wooden form 81 by means of fasteners 82. The pipe-coupling support apparatus of this embodiment is somewhat different than in the FIG. 2 embodiment because it is to be used with wooden forms. When wooden forms are used, it is possible to nail or screw into the forms. However, in the case of the FIG. 3 embodiment, as in the FIG. 2 embodiment, the toroidal wrap 25 of intumescent material is directly positioned adjacent the wooden form wall 81 so that when the form is removed it will be subjected to the atmosphere of the room below the concrete floor 30.

It will be understood by those skilled in the art that the apparatus and method described herein provides a fire-retardant fluid-coupling through concrete floors of buildings which is relatively easy to install but which, more importantly, provides an effective quick closing of the coupling in case of fire to prevent the fire from spreading to the next higher story. It will be appreciated that if the intumescent wrap 25 had been placed on a prior-art embedded coupling joint as is depicted in FIG. 1 the embedded flange thereof would have prevented immediate heating of the intumescent material and, therefore, the material would not have immediately swelled and closed the coupling-joint bore so that the fire could spread to the next higher story before the coupling closes.

It will be further appreciated by those skilled in the art that with this invention a simple, inexpensive, embedded, female/female pipe-coupling joint can be used to form a fire-retardant fluid coupling.

While the invention has been particularly shown and described with reference to preferred embodiments, it will be understood by those skilled in the art that various changes in form and detail may be made therein without departing from the spirit and scope of the invention. For example, it would be possible to replace the fastening means 38 of FIG. 2 with a nut and place threads on the compression column 32 with which the threads of such a nut would mesh. Further, it would be possible to not use an inner double diameter disc 36 but rather have the form-wall end of the pipe-coupling joint 24 engage the lower form wall 26 directly.

The embodiments of the invention in which an exclusive property or privilege is claimed are defined as follows:

1. A fire-retardant, fluid-coupling assembly for producing a fire-retardant, fluid-conveying pipe-coupling joint embedded in a concrete barrier during the casting of said barrier, said coupling assembly comprising:

a fluid-coveying pipe-coupling joint comprising a tubularly-shaped wall for forming a fluid passage, said tubularly-shaped wall having opposite open ends for receiving therein pipes to be coupled with said pipe-coupling joint, said fluid-conveying pipe-coupling joint further comprising a stop means positioned inside said fluid passage for contacting the ends of said pipes inserted into the opposite ends of said tubularly-shaped wall for preventing said pipes from passing further through said tubularly-shaped wall, said fluid-conveying pipe-coupling joint having a form-wall mounting end which does not have an outwardly extending flange for attaching said pipe coupling joint to a form wall thereat;

a pipe-coupling support apparatus for holding said pipe coupling joint on a concrete form while wet concrete is poured into said form, said pipe coupling support apparatus comprising an outer rigid disc means for engaging an outer end of said fluid-conveying pipe-coupling joint which is furthest from said form wall; an elongated compression column attached to said outer disc means for extending through said fluid-conveying pipe-coupling joint to said form wall, said elongated compression column having a length such that it can be attached to said form wall so that said outer disc means pulls the form-wall-mounting end of said pipe coupling rigidly against said form wall; and, a fastening means attached to said compression column for engaging said form wall and thereby holding said fluid-conveying pipe-coupling joint rigidly compressed in a fixed position between said form wall and said outer disc means during the pouring and curing of said concrete; and an intumescent material wrapped about said fluid-conveying pipe coupling at the form-wall-mounting end of said pipe-coupling joint immediately adjacent said form wall to be in contact therewith during the pouring of said concrete into said form, said intumescent material swelling up when it becomes hot;

whereby, when said pipe-coupling support apparatus is used to mount said fluid-conveying pipe-coupling joint with said intumescent material wrapped thereabout on a form wall while concrete is poured thereabout and said form is later removed after the concrete has hardened, an outer edge of the intumescent material wrap adjacent the form-wall-mounting end of the fluid-conveying pipe-coupling joint is exposed to atmosphere below the concrete floor so that a fire in the story below the floor would quickly heat the wrap of intumescent material, causing it to expand and close off the fluid-conveying pipe-coupling joint.

2. A fire-retardant fluid-coupling joint assembly as in claim 1 wherein said compression column passes through a hole in said form wall and wherein is further included a fastening means for attaching to a portion of said compression column on the other side of said form wall for abutting against said other side to thereby hold said fluid-conveying pipe-coupling joint rigidly compressed in a fixed position between said form wall and said outer disc means during the pouring and curing of said concrete.

3. A fire-retardant fluid-coupling joint assembly as in claim 1 wherein said compression column includes an attaching means at the form-wall-mounting end thereof for attaching said compression column to the upper surface of said form wall without passing through said form wall.

4. A method of producing a fire-retardant fluid-coupling in a concrete floor comprising the steps of:

selecting a fluid-conveying pipe-coupling joint having an elongated tubularly-shaped wall for forming a fluid passage, said tubularly-shaped wall having opposite open ends for receiving therein pipes to be coupled with said pipe-coupling joint, said fluid-conveying pipe-coupling joint further being selected to comprise a stop means postioned inside said fluid passage for contacting the ends of said pipes inserted into the opposite open ends of said tubularly-shaped wall for preventing said pipes from passing further through said tubularly-shaped wall, said fluid-conveying pipe-coupling joint being chosen to have a form-wall-mounting end which does not have an outwardly extending flange for attaching said pipe coupling joint to a form wall thereat;

fastening said pipe coupling to a wall of a concrete form with a supporting apparatus comprising an outer rigid disc means for engaging an outer end of said fluid-conveying pipe-coupling joint which is furthest from said form wall; an elongated compression column attached to said outer disc means for extending through said fluid-conveying pipe-coupling joint to said form wall, said elongated compression column having a length such that it can be attached to said form wall so that said outer disc means pulls the form-wall-mounting end of said pipe-coupling joint rigidly against said form wall; and, a fastening means attached to said compression column for engaging said form wall and thereby holding said fluid conveying pipe-coupling joint rigidly compressed in a fixed position between said form wall and said outer disc means during the pouring and curing of said concrete; and wrapping a wrap of intumescent fire-proofing material about the form-wall-mounting end of said tubularly-shaped wall so that it is in contact with said form wall prior to the pouring of concrete into said form;

whereby said concrete is poured about said tubularly-shaped wall of said coupling joint and said wrap of intumescent material and is thereafter left to harden such that once the pipe coupling support apparatus and the form are removed the intumescent material wrap is exposed to atmosphere below a concrete floor so that it is quickly heated upon a fire below said floor to thereby expand and close the fluid passage of said tubularly-shaped wall.

5. A method of producing a fire-retardant fluid-coupling as in claim 4 wherein said pipe-coupling joint is fastened to the lower wall of said concrete form by means of a supporting apparatus whose elongated compression column extends through a hole in the wall of said form and a fastening means is attached to a portion of the compression column on the other side of the form wall for butting against said other side to thereby hold said fluid-conveying pipe-coupling joint rigidly compressed in a fixed position between the form wall and said outer disc means.

6. A method of producing a fire-retardant fluid-coupling joint as in claim 4 wherein said pipe-coupling joint is fastened to a wall of a concrete form by a supporting apparatus in which the support column has at a form-wall mounting end an attaching means which is attached to the upper surface of said form wall without passing through said form wall.

7. A method of producing a fire-retardant fluid-coupling in a concrete floor comprising the steps of:

selecting a fluid-conveying pipe-coupling having an elongaged tubularly-shaped wall for forming a fluid passage, said fluid-conveying pipe-coupling having a form-wall-mounting end;

fastening said pipe coupling to a wall of a concrete form in which said floor will be cast with said form-wall-mounting end of said pipe coupling being at said form wall;

wrapping material about the form-wall mounting end of said tubularly-shaped wall, said material including a wrap of intumescent fire-proofing material, to be in contact with said form wall prior to the pouring of concrete into said form;

pouring concrete in said form about said tubularly-shaped wall of said pipe coupling and said wrap of intumescent material and leaving said concrete to harden;

removing said form and exposing said intrumescent material wrap to atmosphere from below the concrete floor so that it can be quickly heated upon a fire below said floor to thereby expand and close the fluid passage of said tubularly-shaped wall.

* * * * *